US006720940B2

(12) United States Patent
Awamoto et al.

(10) Patent No.: US 6,720,940 B2
(45) Date of Patent: Apr. 13, 2004

(54) METHOD AND DEVICE FOR DRIVING PLASMA DISPLAY PANEL

(75) Inventors: Kenji Awamoto, Kawasaki (JP); Kunio Takayama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 91 days.

(21) Appl. No.: 09/994,791

(22) Filed: Nov. 28, 2001

(65) Prior Publication Data

US 2002/0180665 A1 Dec. 5, 2002

(30) Foreign Application Priority Data

May 31, 2001 (JP) ..... 2001-163857

(51) Int. Cl.[7] ..... G09G 3/28
(52) U.S. Cl. ..... 345/60; 345/63; 345/691
(58) Field of Search ..... 345/60, 61, 63, 345/66, 67, 68, 690, 691, 692, 693; 315/169.4

(56) References Cited

U.S. PATENT DOCUMENTS 6,331,843 B1 * 12/2001 Kasahara et al. ..... 345/63
6,448,947 B1 * 9/2002 Nagai ..... 345/60
6,448,960 B1 * 9/2002 Shigeta ..... 345/204
6,542,135 B1 * 4/2003 Kasahara et al. ..... 345/63

FOREIGN PATENT DOCUMENTS

| | | |
|---|---|---|
| EP | 0 982 707 A1 | 3/2000 |
| JP | 9-6283 | 1/1997 |
| JP | 9-198005 | 7/1997 |
| JP | 10-207426 | 8/1998 |
| JP | 2000-227780 | 8/2000 |

* cited by examiner

*Primary Examiner*—Xiao Wu
(74) *Attorney, Agent, or Firm*—Staas & Halsey LLP

(57) ABSTRACT

A method for driving a plasma display panel is provided, in which an addressing unsusceptible to influence of a variation of operating environment without increasing withstand voltage of circuit components. The method comprises the steps of replacing a frame with a plurality of subframes having luminance weights, setting on or off of light emission of cells for each of the subframes so as to realize a gradation display and providing a drive halt period between at least one of the plural subframe periods allocated to each of the subframes and the next subframe period only when a display load exceeds a preset value.

7 Claims, 11 Drawing Sheets

METHOD AND DEVICE FOR DRIVING PLASMA DISPLAY PANEL

BACKGROUND OF THE INVENTION

1. Field of the Invention

The present invention relates to a method and a device for driving an AC type plasma display panel.

A plasma display panel (PDP) has been widely used as a monitor of a television or a computer since a color screen was commercialized. As a using environment is diversified along with the widespread use, a driving method is desired that can realize a stable display without being affected by temperature variation or voltage regulation of a power source.

2. Description of the Prior Art

As a color display device, a surface discharge format AC type PDP is commercialized. The surface discharge format means a structure in which display electrodes (first electrodes and second electrodes) to be anodes and cathodes in display discharge for ensuring luminance are arranged on a front or a back substrate in parallel, and address electrodes (third electrodes) are arranged so as to cross the display electrode pairs. There are two arrangement forms of the display electrodes. In the first form, a pair of display electrodes is arranged for each row of a matrix display. In the second form, the first and the second display electrodes are arranged alternately at a constant pitch. In the second form, the display electrode except both ends of the arrangement works for displays of two rows. Regardless of an arrangement form, the display electrode pairs are covered with a dielectric layer.

In a display of a surface discharge format PDP, one of the display electrode pair (the second electrode) corresponding to a row is used as a scan electrode for selecting a row, so that address discharge is generated between a scan electrode and an address electrode, which causes address discharge between display electrodes. Thus, an addressing is performed controlling wall charge quantity in the dielectric layer in accordance with display contents. After the addressing, sustaining voltage Vs having alternating polarities is applied to the display electrode pair. The sustaining voltage Vs satisfies the following inequality (1).

$$Vf_{XY}-Vw_{XY}<Vs<Vf_{XY} \quad (1)$$

Here, $Vf_{XY}$ denotes discharge start voltage between display electrodes, and $Vw_{XY}$ denotes wall voltage between display electrodes.

By applying the sustaining voltage Vs, cell voltage (the sum of drive voltage that is applied to the electrode and the wall voltage) exceeds the discharge start voltage $Vf_{XY}$ only in cells having predetermined quantity of wall charge so that surface discharge is generated on the surface of the substrate. When the application period is shortened, light emission looks as being continuous.

A discharge cell of a PDP is basically a binary light emission element. Accordingly, a halftone is reproduced by setting integral light emission quantity of an individual discharge cell in a frame period in accordance with a gradation value of input image data. A color display is a type of the gradation display, and the display color is determined by combining luminance values of three primary colors. For the gradation display, a method is used in which one frame is made of plural subframes (subfields in the case of an interlace display) having luminance weights, and the integral light emission quantity is set by combining on and off of the light emission for each subframe.

FIG. 12 is a diagram of voltage waveforms showing a general driving sequence. In FIG. 12, reference letters X, Y and A denote the first display electrode, the second display electrode and the address electrode, respectively. Each of the numeric letters 1–n added to X and Y indicates the arrangement order of the row corresponding to the display electrodes X and Y. Each of the numeric letters 1–m added to A indicates the arrangement order of the column corresponding to the address electrode A.

A subframe period Tsf assigned to a subframe includes a reset period TR for equalizing charge distribution in the screen, an address period TA for forming the charge distribution in accordance with display contents by applying a scan pulse Py and an address pulse Pa and a sustain period (also referred to as a display period) TS for ensuring a luminance value corresponding to a gradation value by applying a display pulse Ps. The lengths of the reset period TR and the address period TA are constant regardless of a luminance weight, while the length of the sustain period TS is longer as the luminance weight is larger. The illustrated set of waveforms is an example. It is possible to modify the amplitude, the polarity and the timing variously.

In the reset period TR, a writing pulse Prx is applied to all the display electrodes X so that whole surface discharge is generated and the wall charge is erased by self-erasing discharge accompanied with the end of the pulse application. The address electrode A is supplied with a pulse Pra for preventing undesired discharge. There is a method for equalizing the charge distribution, in which a ramp waveform pulse is applied so as to control the charge quantity. In the address period TA, all the display electrodes Y are biased to non-selection potential Vya2 at the start point in time, and then the display electrodes Y corresponding to the selected row i ($1 \leqq i \leqq n$) are biased to selection potential Vya1 temporarily (application of the scan pulse). In synchronization with the row selection, the address electrodes A are biased to the selection potential Vaa only in the column including the selected cells generating the address discharge of the selected rows (application of the address pulse). The address electrodes A of the column including the non-selected cells are biased to the ground potential (usually zero volts). The display electrodes X are biased to a constant potential Vxa from the start to the end of the addressing regardless of being the selected row or the non-selected row. In the sustain period TS, the display pulse Ps having the amplitude Vs is applied to the display electrode Y and the display electrode X alternately. The number of the pulse application is substantially proportional to the luminance weight.

In a PDP, internal electrification characteristics depend on operating temperature, so that a difference of the charged state can be generated between cells depending on a display pattern. As a result, the conventional driving method has a problem that an addressing error is apt to occur because of excessive or insufficient charge at interelectrode AY between the address electrode A and the display electrode Y. This problem will be explained as follows.

FIG. 13 is a diagram of waveforms showing cell voltage variation in the address period of the conventional method. In FIG. 13, thick solid lines indicate appropriate variation of the cell voltage (the sum of the applied voltage and the wall voltage), while chain lines indicate inappropriate variation of the cell voltage.

Here, the k-th cell in the selection order j-th row is noted. A display pattern is supposed, in which an address electrode A corresponding to the k-th column is biased to the address potential Vaa, i.e., the display data $D_{1,k}$-$D_{i,k}$ of the k-th column and of the first through i-th rows are the selected data in the period before the noted row becomes the selected row and while the first through i-th (i<j) rows are the selected rows. The wall voltage at the interelectrode XY at the start point of the address period TA is denoted by Vwxy1, and wall voltage at the interelectrode AY at the start point of the address period TA is denoted by Vway1.

If the operating temperature is relatively low, the wall voltage does not alter before the noted row becomes the selected row remaining substantially at the initial value. Therefore, when the noted row becomes the selected row, and the display electrode $Y_j$ is biased to the selection potential Vya1, and when the address electrode $A_k$ is biased to the address potential Vaa, the cell voltage (Vway1+Vaa−Vya1) at the interelectrode AY exceeds a discharge threshold level $Vf_{AY}$, so that address discharge is generated. The address discharge causes changes of the wall voltage at the interelectrode AY and the wall voltage at the interelectrode XY, followed by formation of a charged state that is suitable for an operation of the subsequent sustain period. The address discharge causes wall voltage Vwxy2 at the interelectrode XY and wall voltage Vway2 at the interelectrode AY.

Before the noted row becomes the selected row, even if the address electrode $A_k$ is biased to the address potential Vaa, discharge cannot be generated because the cell voltage at the interelectrode AY of the noted row is lower than the discharge start threshold level $Vf_{AY}$. However, when environment temperature rises, or heat due to the display is accumulated, the cell temperature may rise above the normal temperature. Accordingly, the cell voltage at the interelectrode AY approaches to the discharge start threshold level $Vf_{AY}$, and the wall voltage at the interelectrode AY may alter when microdischarge is generated even if the cell voltage is below $Vf_{AY}$. There is also the case where remaining minute quantity of space charge affects the wall voltage to alter. Due to the variation of the wall voltage, the cell voltage at the interelectrode AY when the noted row becomes the selected row becomes lower than the normal voltage, and the address discharge intensity (variation quantity of the wall voltage due to the discharge) is lowered. Therefore, the variation quantity of the wall voltage at the interelectrode XY, which is expected to occur at the same time as the variation of the wall voltage at the interelectrode AY during the address discharge, also becomes little. In this case, since the wall voltage (Vwxy2') at the interelectrode XY of the cell to be lighted is insufficient, a lighting error may occur in the subsequent sustain period, resulting in a disturbance of the display.

In order to suppress this undesired variation of the wall voltage, it is good to decrease the difference between the non-selection potential Vya2 of the display electrode Y and the address potential Vaa of the address electrode A. However, the difference between the selection potential Vya1 and the address potential Vaa should be set to a sufficiently large value for ensuring intensity of the address discharge at the interelectrode AY. Therefore, decrease of the difference between the non-selection potential Vya2 and the address potential Vaa and the drop in the address potential Vaa close to the address potential of the non-selection potential mean that the difference between the selection potential Vya1 and the non-selection potential Vya2 of the display electrode Y is enlarged and require increase of withstand voltage of scan circuit components. In the address period, voltage corresponding to the difference between the selection potential Vya1 and the non-selection potential Vya2 is applied across the power source terminals of integrated circuit components called scan drivers. It is necessary to use scan drivers having specifications that can satisfy the voltage. The increase of the withstand voltage of the integrated circuit will cause a substantial increase of the component price.

SUMMARY OF THE INVENTION

An object of the present invention is to stabilize a display by realizing the addressing that is hardly affected by operating environment without increasing withstand voltage of circuit components.

In the present invention, a drive halt period in which no pulse is applied and no electrode bias is switched is provided purposely between at least one of the plural subframe periods and the subsequent subframe period. The language "purposely" means that the length of the drive halt period is longer than 100 microns, preferably more than 200 microns, and is sufficiently long compared with a pulse interval of micron order that is usually set. The form in which a part of the frame period is made the drive halt period includes a light emission control in which at least one subframe is forced to be a non-lighted subframe. In the subframe to be the non-lighted subframe, display discharge is not generated, so at least the sustain period becomes substantially the drive halt period. Furthermore, in the case of a write address format in which the wall voltage of the cell to be lighted is raised, the address period also becomes substantially the drive halt period. By providing the drive halt period, the disturbance of display can be reduced because of the following reason.

It is confirmed by experiments that the disturbance of display due to the incorrect addressing appears conspicuously under the following conditions (1)–(3).

(1) when the surface of the panel is exposed to high temperature.

(2) when a display load factor is 100% or nearly 100%.

(3) when the display load factor of one of the red, green and blue colors is 100% or nearly 100% in a color display.

Here, "display load factor" means a value depending on the sum of the gradation values in one screen of the image data to be displayed and is defined as an average value of a ratio Di/Dmax of all cells when Di ($0 \leqq Di \leqq Dmax$) is the gradation value of the cell i in one frame.

In addition, the following facts (4)–(6) are proved by experiments.

(4) A lighting error is apt to occur in a subframe subsequent to the subframe having a large luminance weight.

(5) A lighting error is generated uniformly in any subframe regardless of the luminance weight.

(6) The larger the luminance weight of the subframe in which a lighting error occurs, the more the lighting error affects the image quality as display unevenness.

Concerning the fact (4), there is a relationship that if a luminance weight of a certain subframe is large (i.e., if the number of display pulses is large), a wall voltage variation $\Delta$Vway of the interelectrode AY in the address period of the subsequent subfield increases. A concrete example of this relationship is shown in FIG. 1.

Considering the conditions and facts (1)–(6), a solution of the problem has been searched. Then, the following facts (7) and (8) are discovered.

(7) A drive halt period is provided between the end of a display of a subframe in which cells are lighted and the start of the addressing of the subsequent subframe. When increasing the length of the drive halt period (i.e., the interval time), the wall voltage variation ⊿Vway of the interelectrode AY in the next subframe decreases, and the lighting error hardly occurs.

(8) If a subframe subsequent to the subframe in which cells are lighted is the non-lighted subframe, the lighting error hardly occurs in the further subsequent subframe, so that the same effect can be obtained as the above-mentioned method in which the interval time is elongated. A concrete example of the relationship between the interval time and the wall voltage variation ⊿Vway is shown in FIG. 2. In this example, the wall voltage variation ⊿Vway can be reduced to below 10 volts when the interval time is 500 microns, and can be reduced down to approximately one volt when the interval time is 1000 microns.

As explained above, it is effective in stabilizing a display to provide the drive halt period. However, since a frame period of a full motion display is fixed to approximately 16.7 milliseconds, the time that can be allocated to the subframe is reduced when a part of the frame period is allocated to the drive halt period. If the number of display pulses is reduced, the luminance is lowered. If the number of subframes is reduced, gradation quality is deteriorated. Therefore, it is practical to provide the drive halt period only when the lighting error is apt to occur, i.e., when a display load is large. In general, when the display load is large, the temperature of the panel surface is high.

When driving a PDP, an automatic power control (APC) is usually performed in which the number of display pulses is decreased responding to increase of the display load for reducing power consumption. When the APC is performed, the sustain period is shortened for a large display load. Therefore, the sum of the subframe periods becomes shorter than the frame period, so that a free time corresponding to the difference between the sum of the subframe periods and the frame period is generated.

The free time generated by the APC is divided to be distributed within the frame period, so that the lighting error can be reduced effectively. If the above-mentioned fact (4) is noted, it is desirable to provide the drive halt period immediately after a subframe having a large luminance weight. If the above-mentioned fact (6) is noted, it is desirable to provide the drive halt period immediately before a subframe having a large luminance weight. In either case, an optimal length of the interval time is determined by the relationship of the luminance weights of the subframes before and after the drive halt period. Therefore, if there is a free time longer than the optimal length, it is desirable to allocate the free time to plural drive halt periods without making one drive halt period longer than a necessary length.

DESCRIPTION OF THE PREFERRED EMBODIMENTS

Hereinafter, the present invention will be explained more in detail with reference to embodiments and drawings.

First Embodiment

Figure 1:
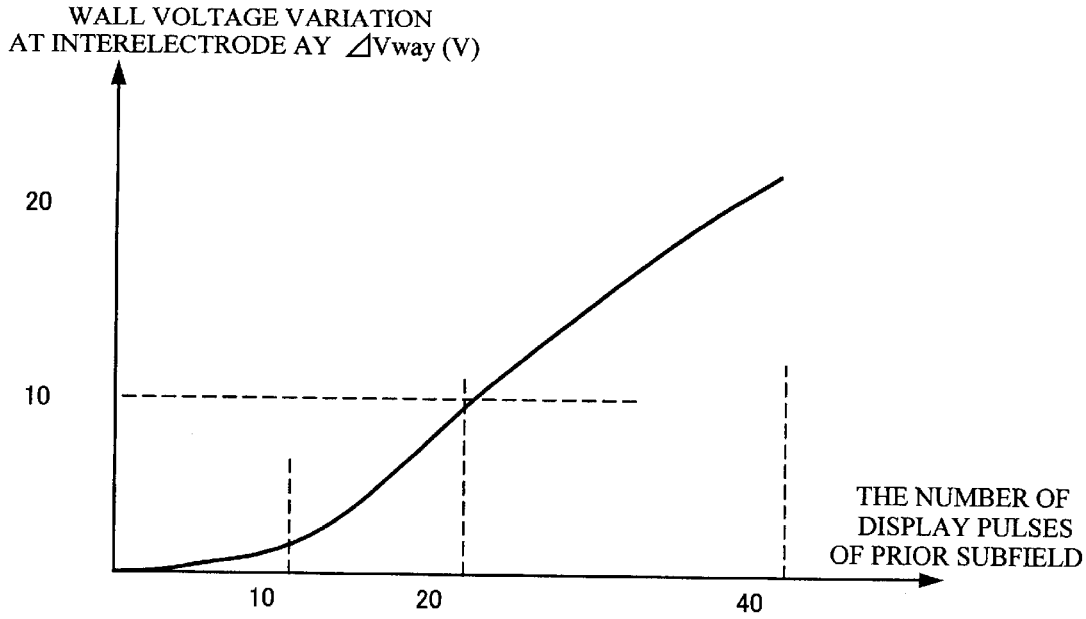
FIG. 1 is a graph showing the relationship between the number of display pulses in a subframe and a wall voltage variation in the next subframe.
Figure 2:
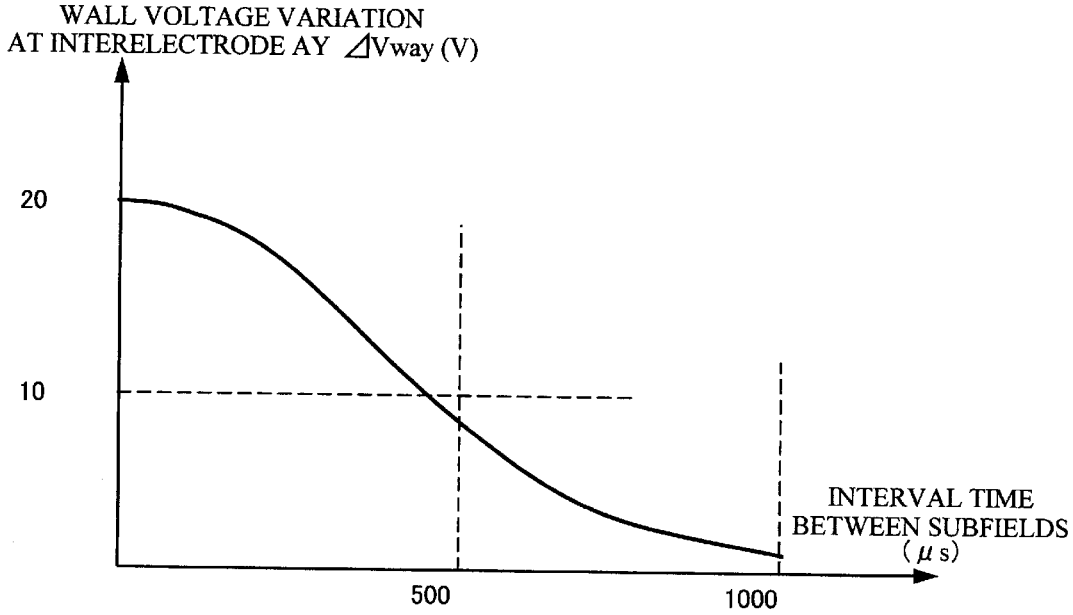
FIG. 2 is a graph showing the relationship between an interval time and a wall voltage variation.
Figure 3:
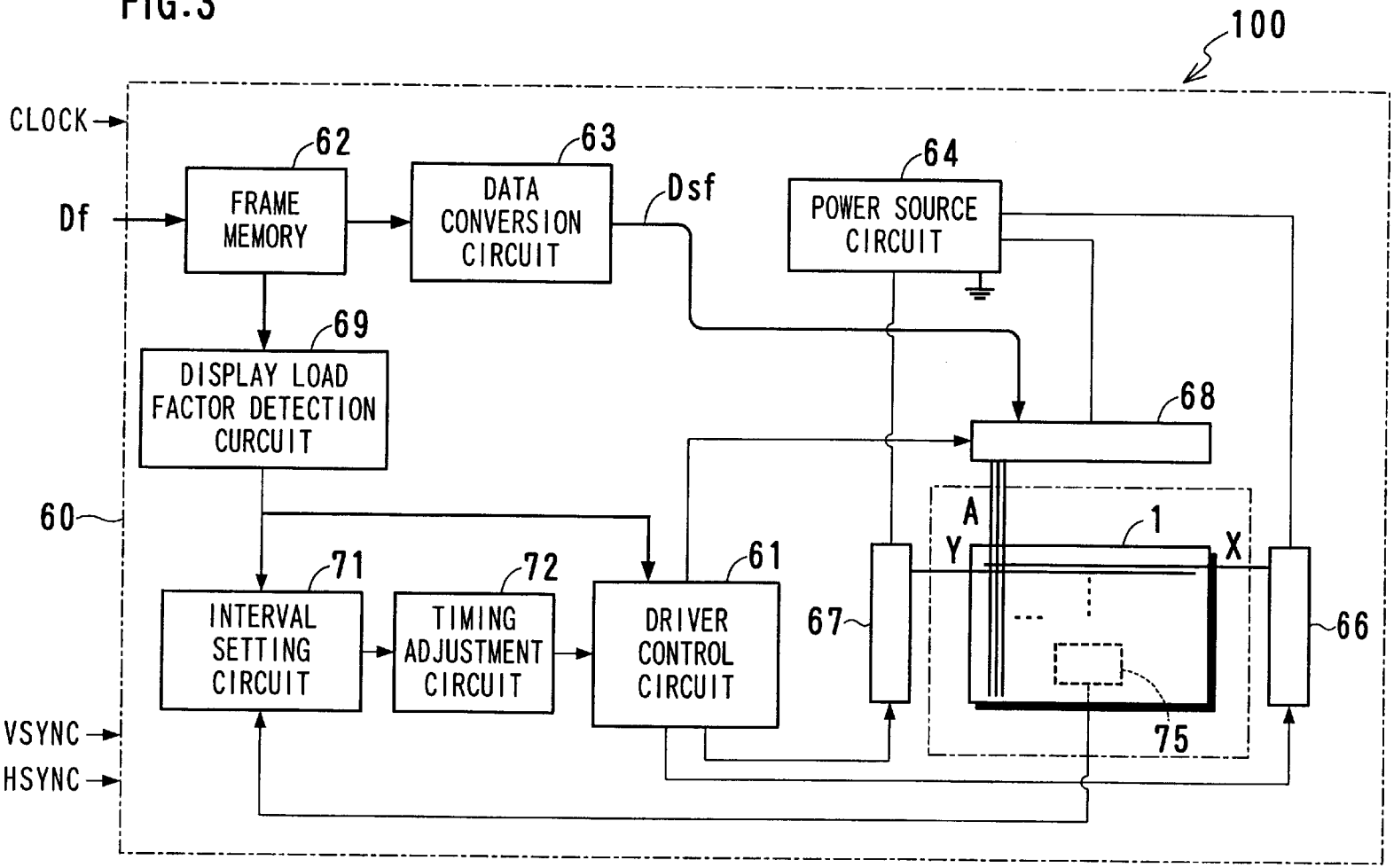
FIG. 3 is a block diagram of a display device according to a first embodiment.

FIG. 3 is a block diagram of a display device according to a first embodiment. The display device 100 comprises a surface discharge type PDP 1 having a screen of m columns and n rows, and a drive unit 60 for selectively lighting cells arranged in a matrix. The display device 100 is used as a wall-hung television set or a monitor of a computer system.

In the PDP 1, display electrodes X and Y for generating display discharge are arranged in parallel, and address electrodes A are arranged so as to cross the display electrodes X and Y. The display electrodes X and Y extend in the row direction (in the horizontal direction) of a screen, and the display electrode Y is used as a scan electrode for selecting a row in addressing. The address electrode A extends in the column direction (in the vertical direction) and is used as a data electrode for selecting a column.

Fundamental functions of the drive unit 60 are realized by a driver control circuit 61, a frame memory 62, a data conversion circuit 63, a power source circuit 64, an X-driver 66, a Y-driver 67, an A-driver 68 and a display load factor detection circuit 69. The drive unit 60 is supplied with frame data Df indicating luminance levels of red, green and blue colors from an external device such as a TV tuner or a computer, together with synchronizing signals VSYNC and HSYNC. The frame data Df are transferred to the data conversion circuit 63 via a frame memory 711 and are converted into subframe data Dsf for a gradation display. The subframe data Dsf is a set of display data containing one bit per cell, and a value of each bit indicates on or off of light emission of the cell in the corresponding subframe, more specifically whether address discharge is necessary or not. In the case of an interlace display, each of plural fields of a frame is made of plural subfields, and a light emission control is performed for each subfield. However, the contents of the light emission control are the same as the case of a progressive display. The X-driver 66 controls potentials of n display electrodes X, while the Y-driver 67 controls potentials of n display electrodes Y. The A-driver 68 controls potentials of total m of address electrodes A in accordance with the subframe data Dsf from the data conversion circuit 63. These drivers are supplied with a control signal from the driver control circuit 61 and are supplied with a predetermined power from the power source circuit 64. The display load factor detection circuit 69 calculates a display load factor for each frame referring to the frame data Df. The display load factor is used for an automatic power control (APC) performed by the driver control circuit 61.

Figure 12:
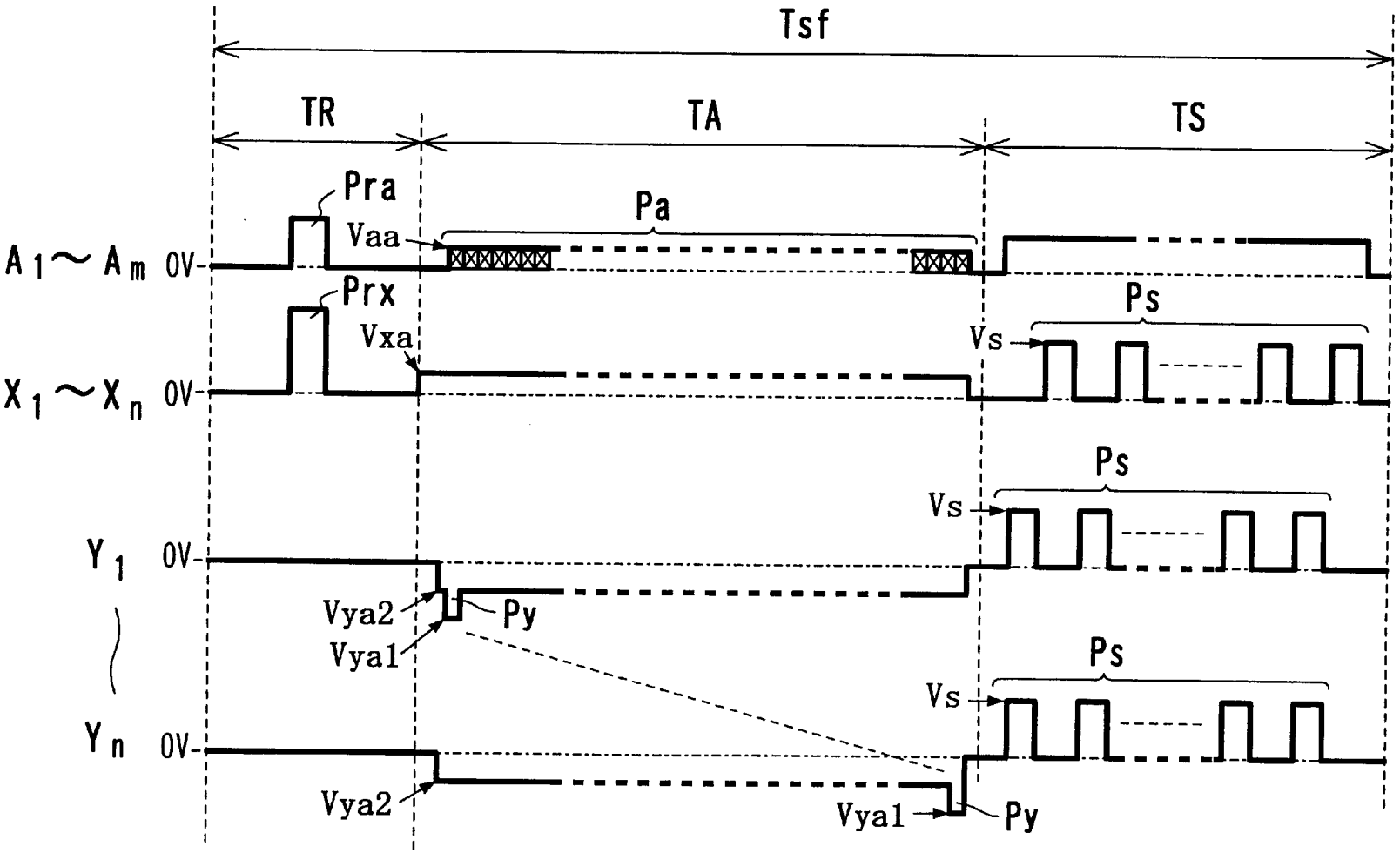
FIG. 12 is a diagram of voltage waveforms showing a general driving sequence.
Figure 13:
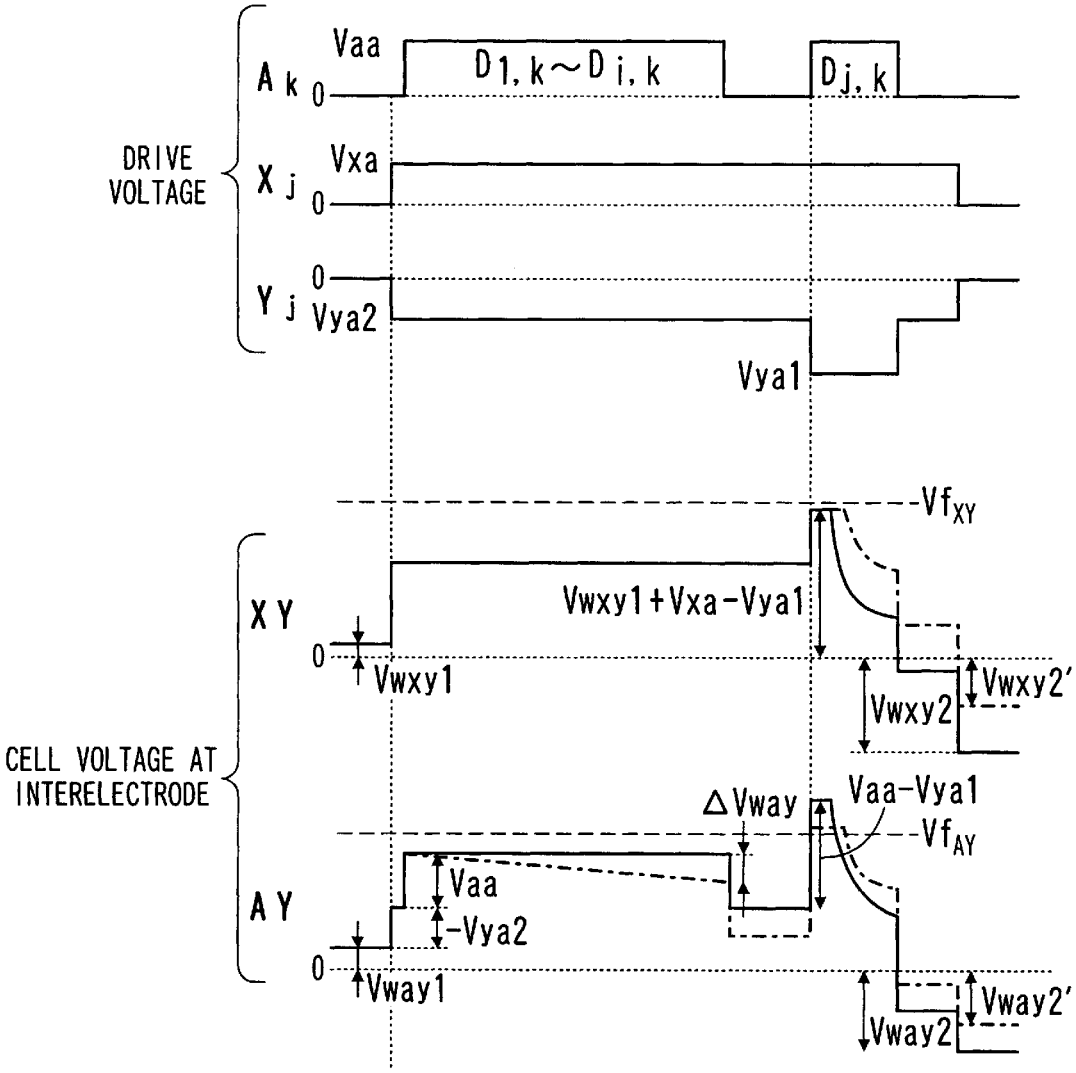
FIG. 13 is a diagram of waveforms showing cell voltage variation in the address period of the conventional method.

In addition, the drive unit 60 includes an interval setting circuit 71 and a timing adjustment circuit 72, which are unique to the present invention. The interval setting circuit 71 determines the interval time immediately after the subframe period in accordance with the display load factor for each subframe period when the temperature of the panel surface detected by the sensor 75 is higher than a preset value. There is a case where the interval time becomes zero for one of the plural subframe periods. If the interval time is not zero, the drive halt period is inserted between the subframe periods. When the drive halt period is inserted, the subsequent subframe periods are delayed sequentially. The timing adjustment circuit 72 starts keeping the interval time from the end of each subframe period and informs the driver control circuit 61 of the start time of the subsequent subframe period. Responding to the start time, the driver control circuit 61 performs a sequence operation concerning a display of one subframe (see FIG. 12).

Figure 4:
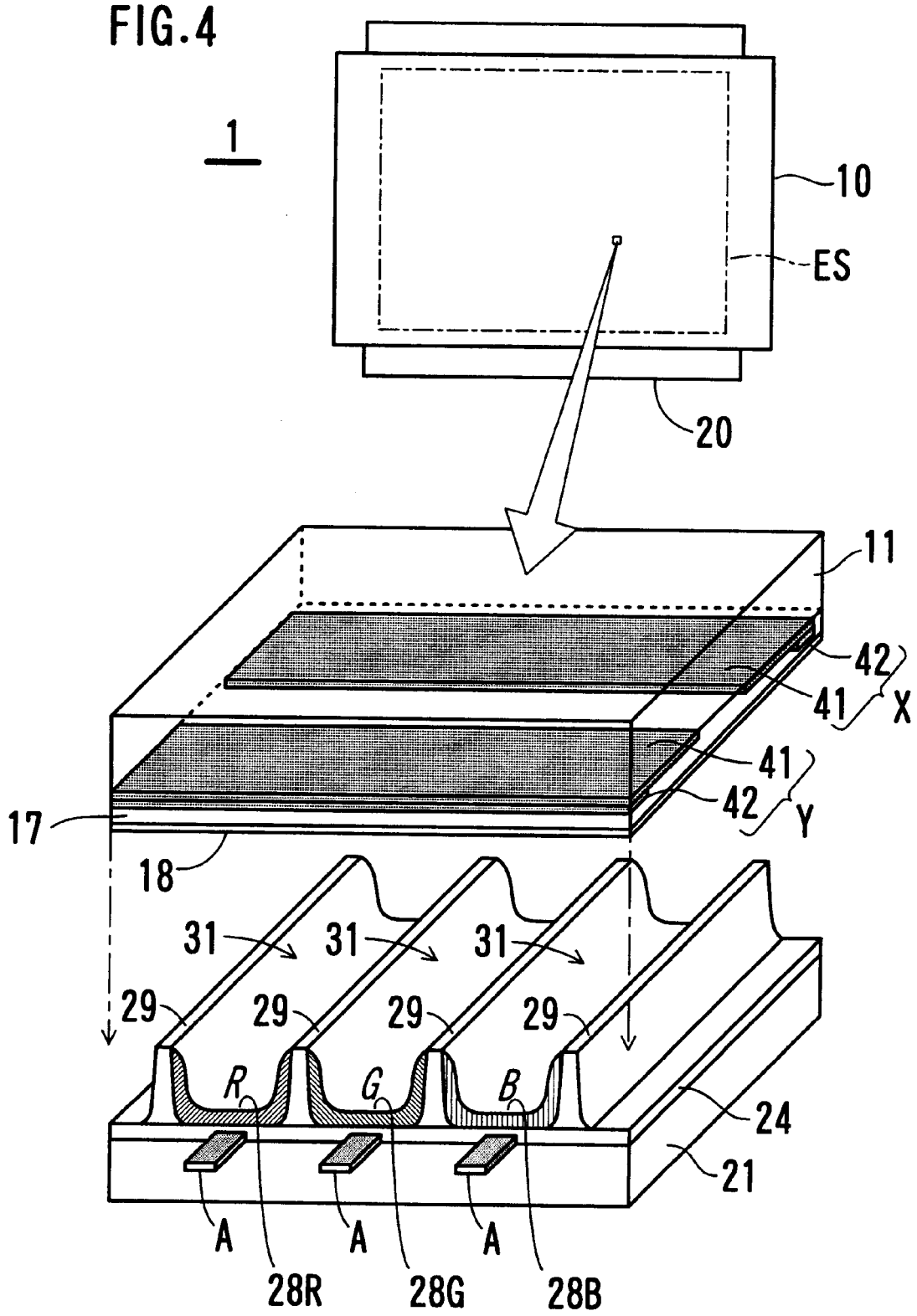
FIG. 4 is a diagram showing a cell structure of a PDP according to the present invention.

FIG. 4 is a diagram showing a cell structure of a PDP according to the present invention. The PDP 1 includes a pair of substrate structures (each of which includes a substrate and elements of discharge cells arranged on the substrate) 10 and 20. In the cell of the display screen ES, the display electrodes X and Y cross the address electrodes A. The display electrodes X and Y are arranged on the inner surface of a front glass substrate 11, and each of the electrodes includes a transparent conductive film 41 forming a surface discharge gap and a metal film (a bus electrode) 42 extending along the entire length of the row. The display electrode pairs are covered with a dielectric layer 17 having the thickness of approximately 30–50 microns, and the surface of the dielectric layer 17 is covered with a protection film 18 made of magnesia (MgO). The address electrodes A are arranged on the inner surface of a back glass substrate 21 and are covered with a dielectric layer 24. On the dielectric layer 24, band-like partitions 29 having the height of approximately 150 microns are arranged so that one partition 29 is disposed between the address electrodes A. The partitions 29 divide the discharge space into plural columns in the row direction. A column space 31 of the discharge space corresponding to a column is continuous over all rows. The back inner surface including upper faces of the address electrodes A and side faces of the partitions 29 is covered with fluorescent material layers 28R, 28G and 28B of red, green and blue colors for a color display. The italic alphabet letters R, G and B in FIG. 4 denote light emission colors of the fluorescent material layers 28R, 28G and 28B, respectively. Each of the fluorescent material layers 28R, 28G and 28B is excited locally to emit light by ultraviolet rays emitted by a discharge gas.

Hereinafter, a driving method of the PDP 1 of the display device 100 will be explained.

Figure 5:
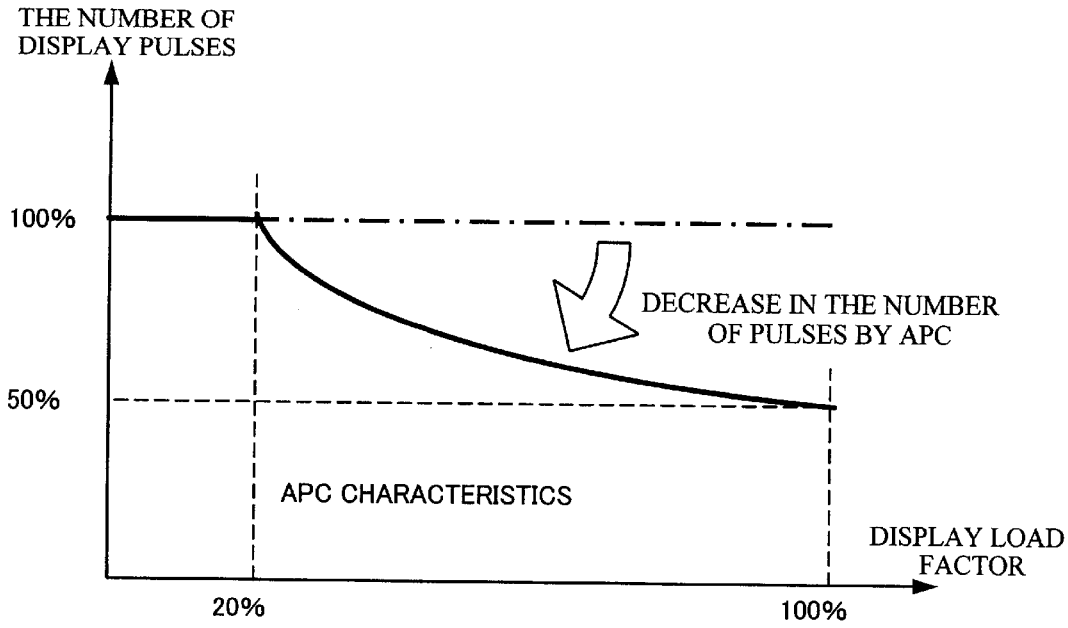
FIG. 5 is a graph showing characteristics of an automatic power control.

FIG. 5 is a graph showing characteristics of the automatic power control.

When the display load factor exceeds 20%, an automatic power control function works, and the number of display pulses decreases along with the increase of the display load factor. The number of the display pulses when the display load factor is 100% becomes one half of that when the display load factor is below 20%.

Figure 6:
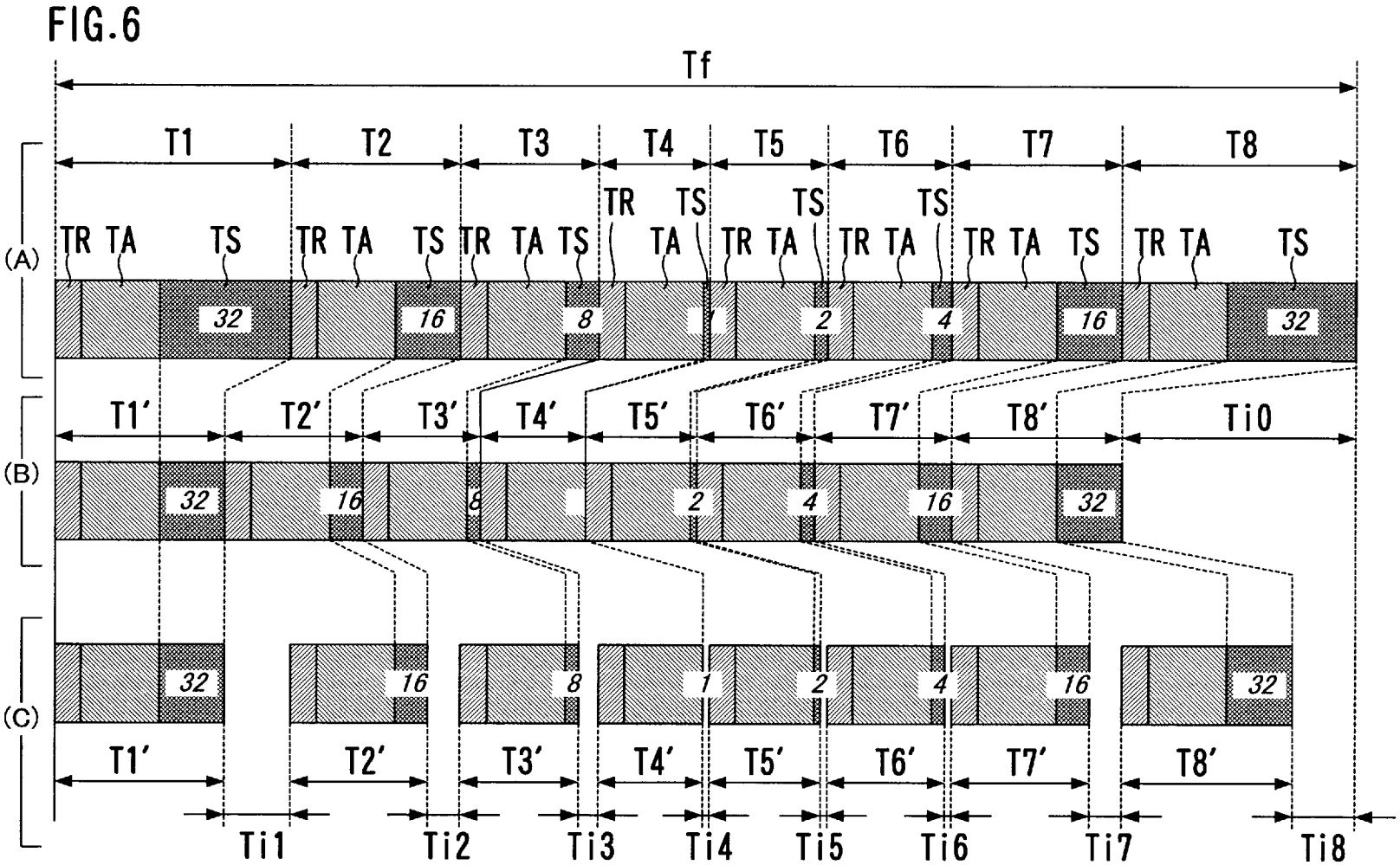
FIG. 6 is a diagram showing period setting in the first embodiment.

FIG. 6 is a diagram showing period setting in the first embodiment.

In this example, one frame is made of eight subframes. As shown by italic numerals in FIG. 6, the luminance weights of these subframes are 32, 16, 8, 1, 2, 4, 16 and 32, respectively. The reset period TR, the address period TA and the sustain period TS are allocated to each of the subframes. The length of the sustain period TS depends on the luminance weight.

When the display load factor is 20% or less, all the remaining time (e.g., 7.1 milliseconds), i.e., the frame period Tf (approximately 16.7 milliseconds) minus the time necessary for total 8 times of the initialization and the addressing (e.g., 1.2 milliseconds×8) are allocated to the eight subframes in accordance with the luminance weights. Namely, the number of the display pulses is the maximum. In this case, the sum of the eight subframe periods T1, T2, T3, T4, T5, T6, T7 and T8 is substantially the same as the frame period Tf (the state (A) in FIG. 6).

When the display load factor exceeds 20%, the automatic power control function decreases the number of display pulses as explained above. In this way, the sustain period TS of each subframe is shortened, and the sum of the eight subframe periods T1', T2', T3', T4', T5', T6', T7' and T8' becomes shorter than the frame period Tf. If the temperature of the panel surface is lower than a preset value, the drive halt period is not provided between the subframe periods, and a free period Ti0 (e.g., 3.5 milliseconds) is generated after the final subframe period T8' as shown in (B) of FIG. 6. On the contrary, if the temperature of the panel surface is higher than the preset value, the drive halt periods Ti1, Ti2, Ti3, Ti4, Ti5, Ti6, Ti7 and Ti8 are provided after each of the subframe periods as shown in (C) of FIG. 6. Here, when setting the length of the drive halt period (the interval time ti), longer interval times are provided immediately before and immediately after the subframe having a large luminance weight, as a weighting process. In the illustrated example, the long drive halt periods Ti1 and Ti8 are provided between the subframe period T1' and the subframe period T2' as well as between the subframe period T8' and the subframe period T1' of the next frame.

Figure 7:
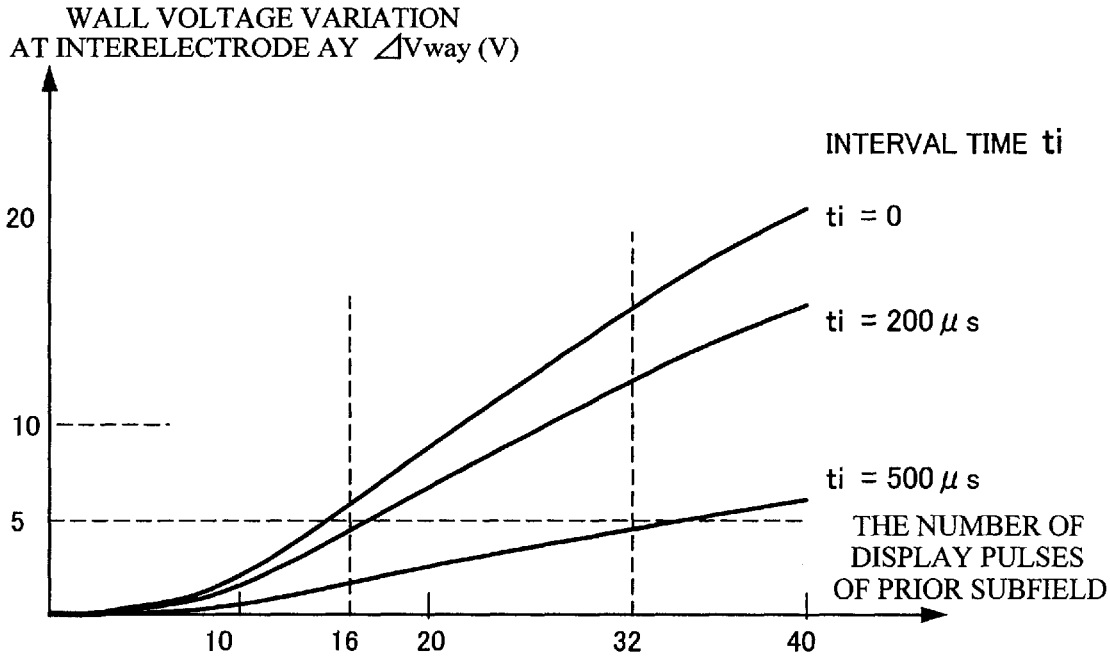
FIG. 7 is a graph showing the relationship between the length of the interval time and the effect thereof.

FIG. 7 is a graph showing the relationship between the length of the interval time and the effect thereof.

The longer the interval period ti is, the smaller the ⊿Vway becomes. In FIG. 7, it is supposed that if ⊿Vway is below 5 volts, an address discharge error can be prevented, for example. Then, the interval time of 200 microseconds is provided after the subframe whose number of display pulses is 16, and the interval time of 500 microseconds is provided after the subframe whose number of display pulses is 32, so that ΔVway becomes below 5 volts in the address period of the subsequent subframe.

Second Embodiment

Figure 8:
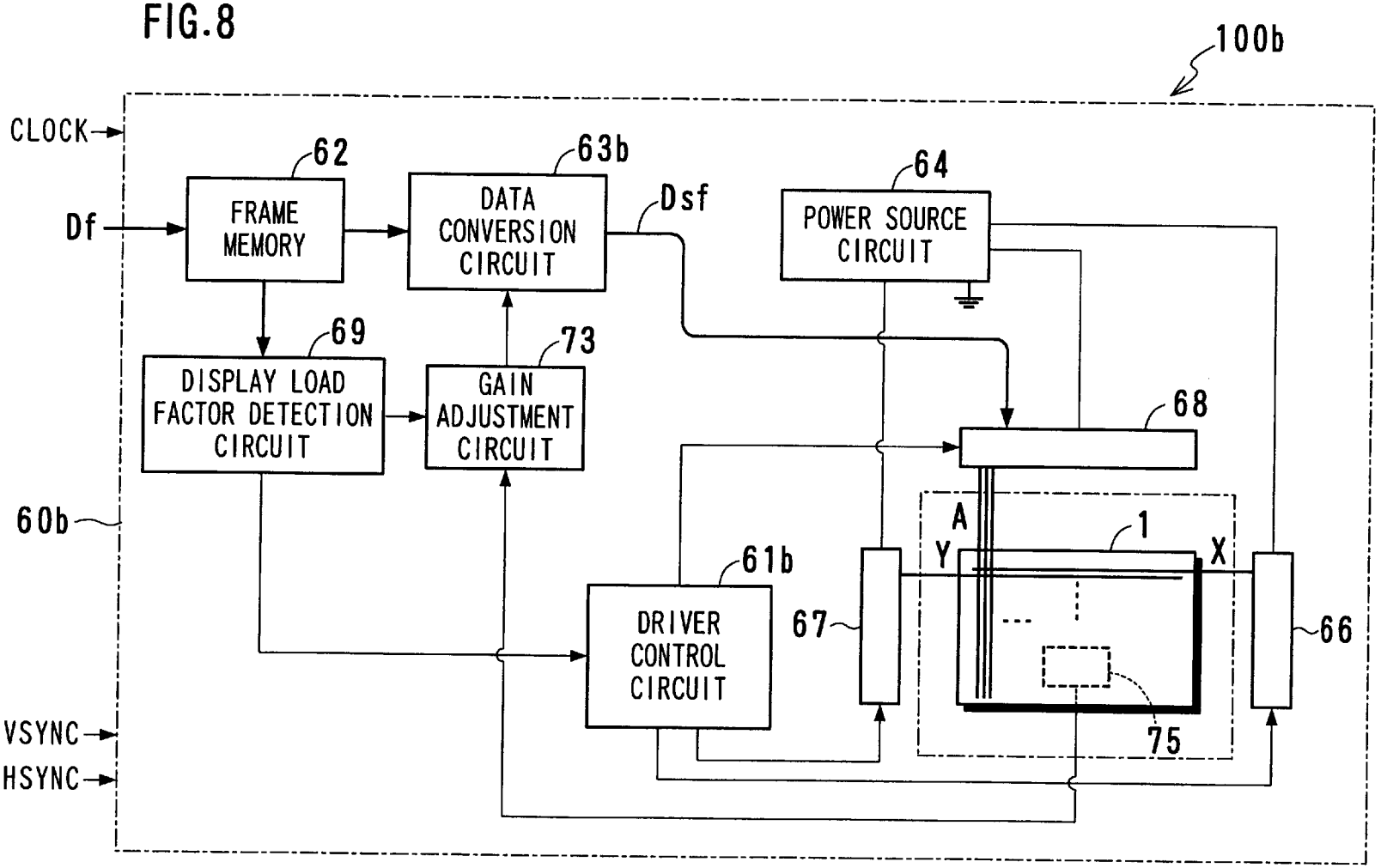
FIG. 8 is a block diagram of a display device according to a second embodiment.

FIG. 8 is a block diagram of a display device according to a second embodiment. In FIG. 8, elements having the same functions as the above-mentioned example are denoted by the same reference characters.

The display device 100*b* includes a surface discharge type PDP 1 and a drive unit 60*b* for driving the PDP 1. Fundamental functions of the drive unit 60*b* are realized by a driver control circuit 61*b*, a frame memory 62, a data conversion circuit 63*b*, a power source circuit 64, an X-driver 66, a Y-driver 67, an A-driver 68 and a display load factor detection circuit 69. The display load factor detection circuit 69 refers to the frame data Df and calculates the display load factor for each frame. The display load factor is used for the automatic power control (APC) performed by the driver control circuit 61*b*. In addition, the drive unit 60*b* is equipped with a gain adjustment circuit 73 that is unique to the present invention. The gain adjustment circuit 73 performs a gain adjustment in which a gradation value of a frame is changed in accordance with a display load factor when the temperature of the panel surface detected by a sensor 75 is higher than a preset value.

Figure 9:
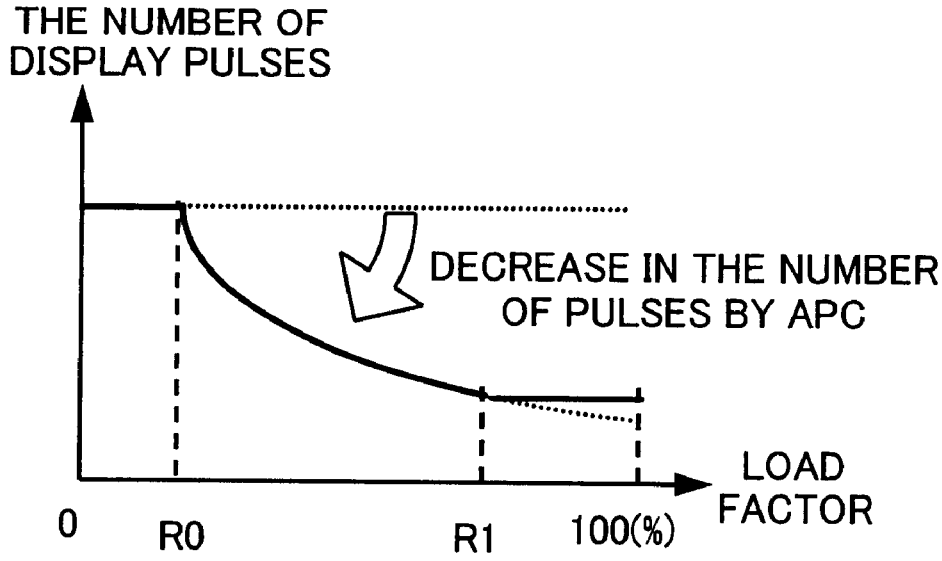
FIG. 9 is a graph showing characteristics of the automatic power control.

FIG. 9 is a graph showing characteristics of the automatic power control.

In the second embodiment, the automatic power control function works when the display load factor exceeds a first preset value R0 (e.g., 20%), and the number of display pulses increases or decreases responding to increase or decrease of the display load factor within the range from the first preset value R0 to a second preset value R1 (e.g., 70%). The number of display pulses is not changed when the display load factor is below the preset value R0 or above the preset value R1.

Figure 10:
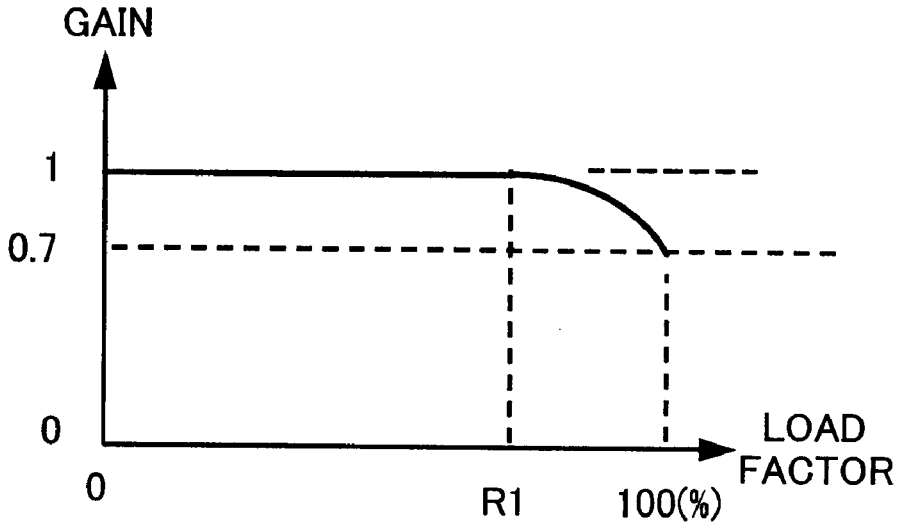
FIG. 10 is a graph showing characteristics of a gain adjustment.

FIG. 10 is a graph showing characteristics of the gain adjustment.

Figure 11:
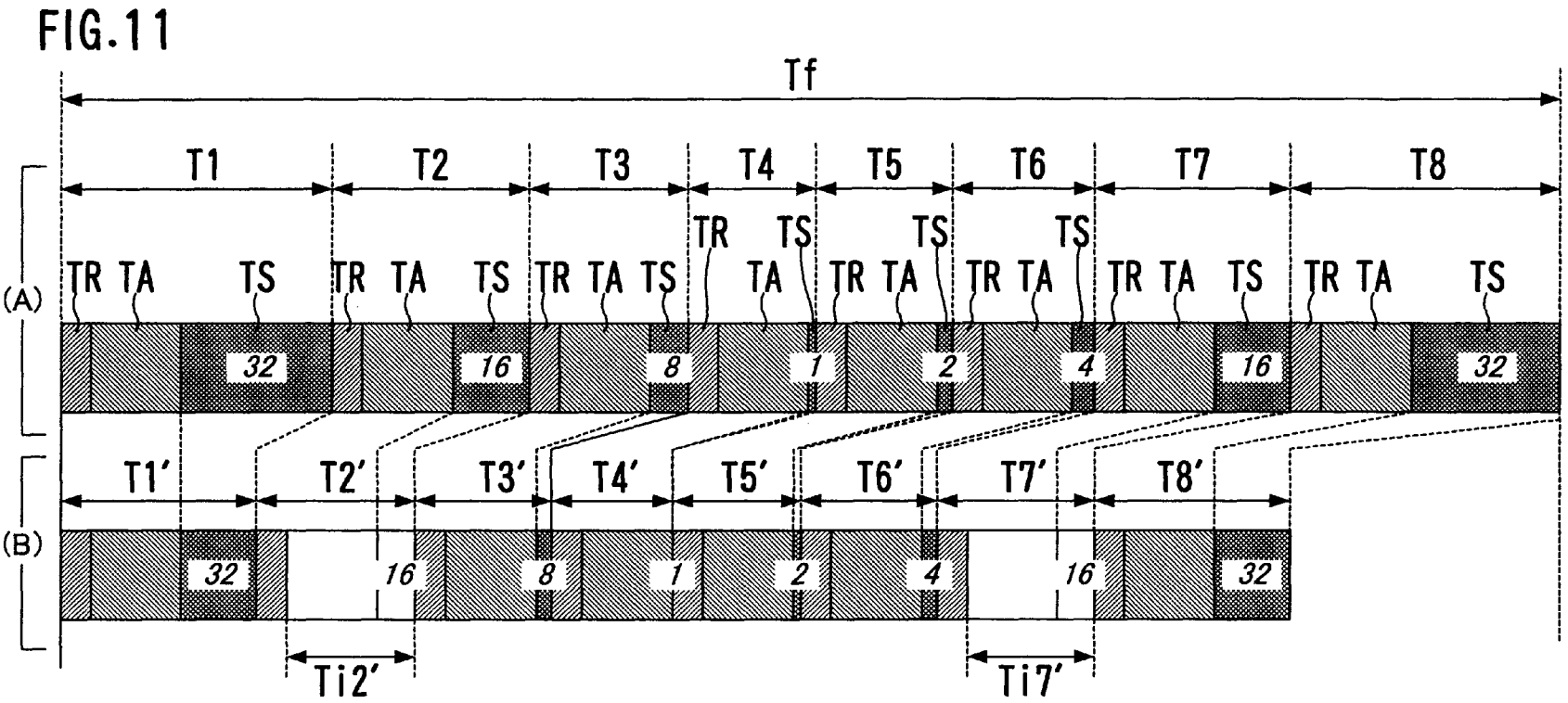
FIG. 11 is a diagram showing period setting according to the first embodiment.

When the display load factor is below the preset value R1, subframe data Dsf is generated that indicates the same gradation that the frame data Df indicates. Namely, the gain is one. When the display load factor has a value above the preset value R1, the gain adjustment is performed in which the larger the display load factor is, the more the gradation is decreased. In this way, at least one subframe is forced to be a non-lighted subframe, so that a drive halt period is generated substantially. Therefore, power consumption is reduced by the same rate as the automatic power control, and the wall voltage is prevented from varying in the address period. In the illustrated example, if the display load factor is 100% for example, the data conversion circuit 63*b* outputs the subframe data Dsf for displaying the gradation value that is the product of the gradation value of the frame data Df and the gain 0.7. In this case, supposing that the number of display pulses is 111 (=1+2+4+8+16+16+32+32) when all the subframes are lighted, the number of display pulses becomes 78 after being multiplied by the gain 0.7. Accordingly, subframes corresponding to 33 (=111−78) pulses are turned off, and two subframes whose number of display pulses is 16 become the drive halt periods Ti2' and Ti7' as shown in FIG. 11, which bring the effect of making the interval free.

In the above-mentioned first and second embodiments, it is possible to omit monitoring the temperature of the panel surface, and to provide the drive halt period in accordance with the display load factor. It is also possible to detect a power consumption for deciding whether or not to provide the drive halt period.

According to the first and the second embodiments, since the period that was a free time is utilized, the display can be stabilized without changing the specification such as the number of subframes, the number of display pulses and the address time.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method of driving a plasma display panel, comprising:

replacing a frame with three or more subframes having luminance weights; setting light emission of cells on or off for each of the subframes so as to realize a gradation display;

providing a drive halt period after a final subframe period in a frame in which a sum of subframe periods that are allocated to the subframes is shorter than a frame period, when a temperature of a panel surface is not more than a preset temperature, the drive halt period having a length corresponding to a difference between the frame period and the sum of the subframe periods;

providing a plurality of drive halt periods having length weights corresponding to a luminance weight arrangement in a frame in which the sum of the subframe periods is shorter than the frame period, when the temperature of the panel surface exceeds the preset temperature; and allocating a free time that is the difference between the frame period and the sum of the subframe periods to the plurality of drive halt periods in accordance with the length weights thereof.

2. The method according to claim 1, wherein the plurality of drive halt periods are provided immediately after two or more subframe periods selected in a decreasing order of corresponding luminance weights.

3. The method according to claim 1, wherein the plurality of drive halt periods are provided immediately before two or more subframe periods selected in a decreasing order of corresponding luminance weights.

4. The method according to claim 1, further comprising performing a power control in which a number of display discharge times in each of the subframe periods is increased or decreased in response to an increase or a decrease of a display load only when the display load is a value ranging from a first preset value to a second preset value.

5. The method according to claim 4, further comprising performing a gain adjustment in which a gradation of the frame is increased or decreased in response to the increase or the decrease of the display load only when the display load exceeds the second preset value.

6. A device for driving a plasma display panel, the device realizing a gradation display by replacing a frame with three or more subframes having luminance weights and by controlling on or off intervals of light emission of cells for each of the subframes, wherein:

a drive halt period is provided after a final subframe period in a frame in which a sum of subframe periods that are allocated to the subframes is shorter than a frame period, when a temperature of a panel surface is not more than a preset temperature, the drive halt period having a length corresponding to a difference between the frame period and the sum of the subframe periods;

a plurality of drive halt periods is provided that have length weights corresponding to a luminance weight arrangement in a frame in which the sum of the subframe periods is shorter than the frame period, when the temperature of the panel surface exceeds the preset temperature; and a free time that is the difference between the frame period and the sum of the subframe periods is allocated to the plurality of drive halt periods in accordance with the length weights thereof.

7. A display device comprising an AC type plasma display panel and a driving device for driving the plasma display panel, the driving device realizing a gradation display by replacing a frame with three or more subframes having luminance weights and by controlling on or off intervals of light emission of cells for each of the subframes, wherein:

a drive halt period is provided after a final subframe period in a frame in which a sum of subframe periods that are allocated to the subframes is shorter than a frame period, when a temperature of a panel surface is not more than a preset temperature, the drive halt period having a length corresponding to a difference between the frame period and the sum of subframe periods;

a plurality of drive halt periods is provided that have length weights corresponding to a luminance weight arrangement in a frame in which the sum of the subframe periods is shorter than the frame period, when the temperature of the panel surface exceeds the preset temperature; and a free time that is the difference between the frame period and the sum of the subframe periods is allocated to the plurality of drive halt periods in accordance with the length weights thereof.

* * * * *

UNITED STATES PATENT AND TRADEMARK OFFICE

CERTIFICATE OF CORRECTION

PATENT NO. : 6,720,940 B2
DATED : April 13, 2004
INVENTOR(S) : Kenji Awamoto et al.

It is certified that error appears in the above-identified patent and that said Letters Patent is hereby corrected as shown below:

Column 9,
Line 57, begin a new paragraph with “setting”.

Signed and Sealed this

First Day of June, 2004

JON W. DUDAS
*Acting Director of the United States Patent and Trademark Office*